US006408555B1

(12) United States Patent
Sapia et al.

(10) Patent No.: US 6,408,555 B1
(45) Date of Patent: Jun. 25, 2002

(54) ELECTRONIC TRIGGER LOCK APPARATUS AND SYSTEM

(76) Inventors: Franco Sapia, 9 Wright Rd., Derry, NH (US) 03038; Thomas B. Brundage, P.O. Box 418, Ottawa, KS (US) 66067

( * ) Notice: Subject to any disclaimer, the term of this patent is extended or adjusted under 35 U.S.C. 154(b) by 0 days.

(21) Appl. No.: 09/656,937

(22) Filed: Sep. 7, 2000

(51) Int. Cl.[7] ..... F41A 17/00

(52) U.S. Cl. ..... 42/70.07; 42/70.11; 70/276; 70/63

(58) Field of Search ..... 42/70.01–70.11

(56) References Cited

U.S. PATENT DOCUMENTS

| | | | | | |
|---|---|---|---|---|---|
| 4,189,712 | A | | 2/1980 | Lamelson | 340/149 |
| 4,457,091 | A | | 7/1984 | Wallerstein | 42/1 |
| 4,467,545 | A | | 8/1984 | Shaw, Jr. | 42/70 |
| 5,016,376 | A | * | 5/1991 | Pugh | 42/70.06 |
| 5,022,175 | A | | 6/1991 | Oncke et al. | 42/70.11 |
| 5,392,552 | A | * | 2/1995 | McCarthy et al. | 42/70.06 |
| 5,394,717 | A | * | 3/1995 | Yu | 70/276 |
| 5,419,068 | A | | 5/1995 | Pages et al. | 42/70.07 |
| 5,448,847 | A | | 9/1995 | Teetzel | 42/70.11 |
| 5,461,812 | A | * | 10/1995 | Bennett | 42/70.06 |
| 5,479,149 | A | | 12/1995 | Pike | 42/70.07 |
| 5,487,234 | A | * | 1/1996 | Dragon | 340/571 |
| 5,570,528 | A | * | 11/1996 | Teetzel | 42/70.05 |
| 5,704,151 | A | | 1/1998 | West et al. | 42/70.11 |
| 5,860,241 | A | | 1/1999 | Waters | 42/70.11 |
| 5,898,241 | A | | 4/1999 | Ganderillas | 307/419 |
| 5,908,103 | A | | 6/1999 | Dlugos | 194/210 |
| 5,924,232 | A | * | 7/1999 | Rhoden et al. | 42/70.11 |
| 5,946,840 | A | | 9/1999 | Mickel | 42/70.11 |
| 5,987,941 | A | * | 11/1999 | Zocco | 109/59 R |
| 6,155,089 | A | * | 12/2000 | Hurskainen et al. | 70/187 |
| 6,282,829 | B1 | * | 9/2001 | Mossberg et al. | 42/70.11 |
| 6,301,815 | B1 | * | 10/2001 | Sliwa | 42/70.01 |
| 2001/0027671 | A1 | * | 10/2001 | Davis | 70/278.3 |

* cited by examiner

*Primary Examiner*—Michael J. Carone
*Assistant Examiner*—Denise J Buckley
(74) *Attorney, Agent, or Firm*—Dale J. Ream

(57) ABSTRACT

A system and apparatus for preventing unauthorized access to a trigger of a firearm comprises a database of PIN numbers associated with a plurality of trigger locks and access tokens, each corresponding trio being represented by a common identification code. At a point of purchase, a consumer receives a two-piece trigger lock secured about the trigger of a purchased firearm as well as an access token. Each token includes a unique number or configuration of ferro-magnetic wires. Each trigger lock includes a magnetic read head which generates voltage pulses when a token is positioned in close proximity thereto. This positioning causes the ferro-magnetic wires to switch magnetic states, thus invoking electromagnetic impulses. If a background check of the firearm purchaser, initiated at the point of purchase, is approved, a central computer coupled to the database and to a computer network displays a personal identification number (PIN). Entry of this PIN into a keypad on a corresponding trigger lock actuates the read head and a token may be positioned thereby. A processor coupled to the read head is able to determine if the trigger lock and token match and, if so, to actuate a release of the trigger lock from about the trigger.

10 Claims, 4 Drawing Sheets

ELECTRONIC TRIGGER LOCK APPARATUS AND SYSTEM

BACKGROUND OF THE INVENTION

This invention relates generally to trigger locks and, more particularly, to an apparatus and system which releases a trigger lock only upon background check approval, subsequent entry of a personal identification number, and matching of ferro-magnetic access codes relative to the respective trigger lock.

The need for more stringent standards relative to background checks on firearm purchasers and mandatory provision of trigger locks on purchased firearms has been suggested with increasing frequency and fervor. While numerous trigger locks of a conventional type have been proposed in the art, existing devices do not provide a comprehensive system which permits release of the lock from the trigger of a firearm only upon approval of a background check as well as possession of a special magnetic access token.

Therefore, it is desirable to have an apparatus and system for releasing a trigger lock from a firearm upon entry of a personal identification code issued through a computer network following approval of a firearm purchaser background check. Further, it is desirable to have an apparatus which also requires that a token having a unique ferro-magnetic wire configuration be recognized by a read head within a corresponding trigger lock before the trigger lock is released.

SUMMARY OF THE INVENTION

A system for preventing unauthorized access to the trigger of a firearm according to a preferred embodiment of the present invention includes a plurality of trigger locks and tokens. The system further includes a database of personal identification numbers (PIN's) associated with the trigger locks and tokens. Each trio of a corresponding PIN, trigger lock, and token are represented by a unique identification code. This code is imprinted on the corresponding trigger lock and token prior to the time of purchase and will be used later to supply a corresponding PIN to a consumer following approval of a background check. Each trigger lock includes a two-piece housing releasably coupled with a locking bolt that is pivotally coupled to one portion of the housing and rotatably activated by a solenoid.

At the time of a firearm purchase, a consumer fills out documentation that is later used to conduct a background check designed to verify the consumer's fitness to bear a firearm, such as checking for felony convictions, pending warrants, etc. This documentation will include the identification code of the trigger lock and token sold to the consumer. Upon approval of the background check, a central computer coupled to the database and a wide area computer network such as the Internet will display the PIN associated with the identification code in response to the consumer entering that identification code. One section of each trigger lock housing includes a keypad into which the PIN may be entered. Comparator circuitry is also included within that section and coupled to the keypad for determining if the PIN matches the predetermined PIN corresponding to the trigger lock identification code. If they match, the comparator circuitry delivers a signal to enable a read head.

Each token includes a unique number or configuration of ferro-magnetic wires. These wires are specifically formed to switch magnetic states when proximately exposed to a magnetic read head disposed within each trigger lock assembly. This magnetic switching of the wire induces a short duration voltage impulse across the read head. Each read head is coupled to a processor which converts the voltage impulses into a numeric value. This actual or sensed value is then compared to a predetermined value to identify whether the token was the appropriate or expected one. If the values match, the processor delivers a signal to the solenoid of the coupling mechanism to release the trigger lock housing sections.

Therefore, a general object of this invention is to provide a system for preventing unauthorized access to the trigger of a firearm.

Another object of this invention is to provide a system, as aforesaid, having a plurality of trigger locks which cannot be released until a background check has been completed and a PIN corresponding to a respective trigger lock is input into a keypad thereon.

Still another object of this invention is to provide a system, as aforesaid, in which the PIN is displayed over a wide area network upon approval of a background check and upon a user entry of a corresponding identification code.

Yet another object of this invention is to provide a system, as aforesaid, in which a trigger lock is not released until a unique magnetically encoded token is passed proximately over a read head in a trigger lock and generates electromagnetic impulses having a value which matches a predetermined value.

A further object of this invention is to provide a system, as aforesaid, in which an unlocked trigger lock is automatically locked again if the two-part trigger lock housing is not separated within a predetermined amount of time after the trigger lock has been unlocked.

A still further object of this invention is to provide a system, as aforesaid, in which a token is small and capable of being carried on a key ring.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
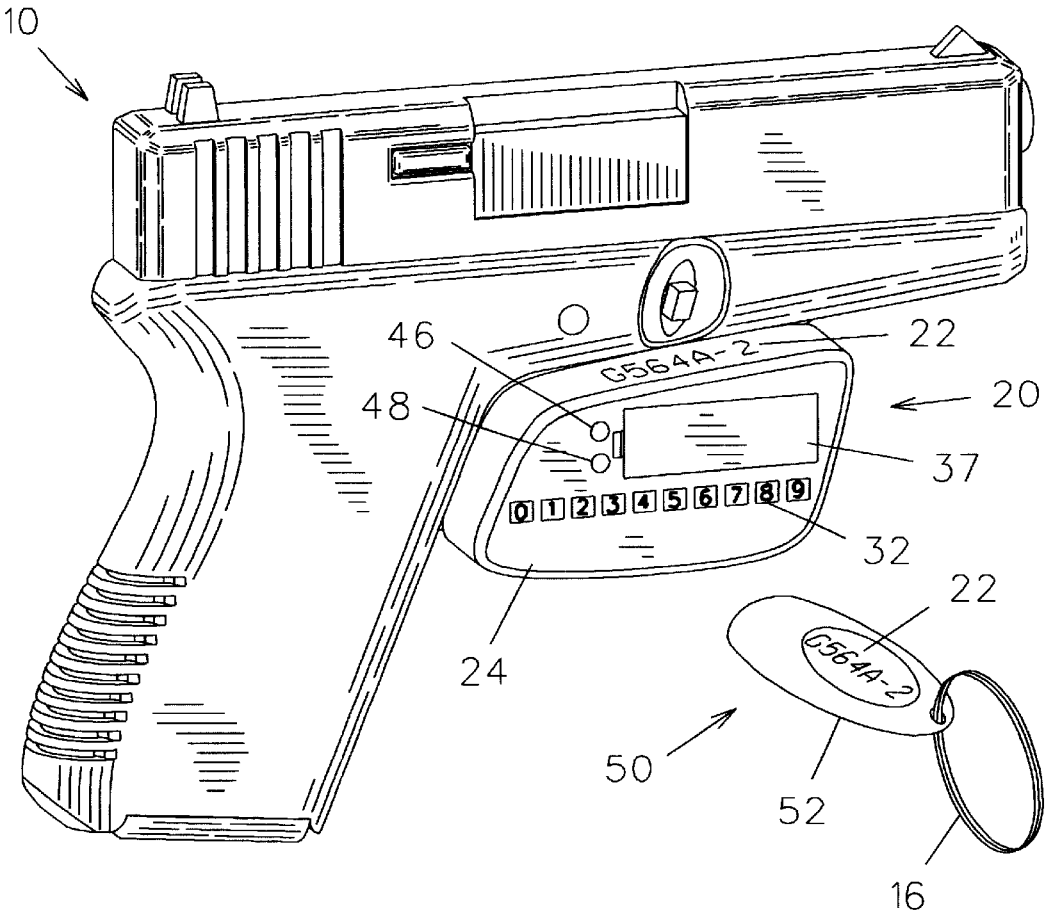
FIG. 1 is a perspective view of a trigger lock in a locked configuration on a firearm according to a preferred embodiment of the present invention.

An apparatus and system for preventing unauthorized access to the trigger of a firearm according to a preferred embodiment of the present invention will now be described with reference to FIGS. 1 through 5 of the accompanying drawings.

The system includes a plurality of trigger locks 20, tokens 50, and a database of personal identification numbers (PIN's) associated with the plurality of trigger locks 20 and tokens 50. More particularly, each trio of a corresponding PIN, trigger lock 20, and token 50 is represented in the database by a unique identification code 22. This code 22 is imprinted in ink or stamped on each corresponding trigger lock 20 and token 50 prior to a point of purchase and will be used in issuing a corresponding PIN, as to be described more fully later. It should be appreciated that the database may also include other information added subsequent to a purchase transaction, such as the purchaser's name, address, phone number, etc. This information is gleaned from purchase documents filled out at the time of purchase and which are also used to facilitate the background check.

Figure 2:
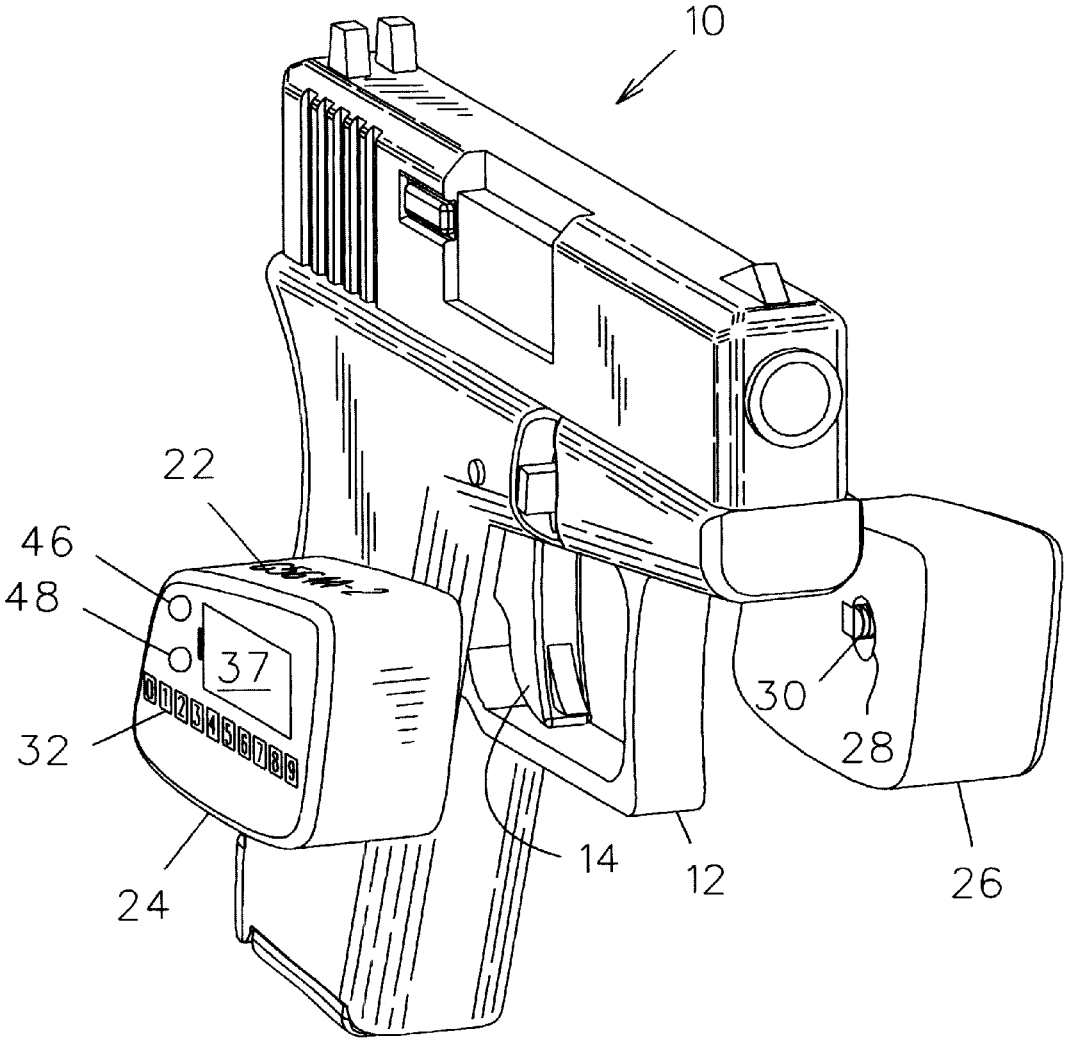
FIG. 2 is a front perspective view of the trigger lock in an unlocked configuration decoupled from the firearm.
Figure 3:
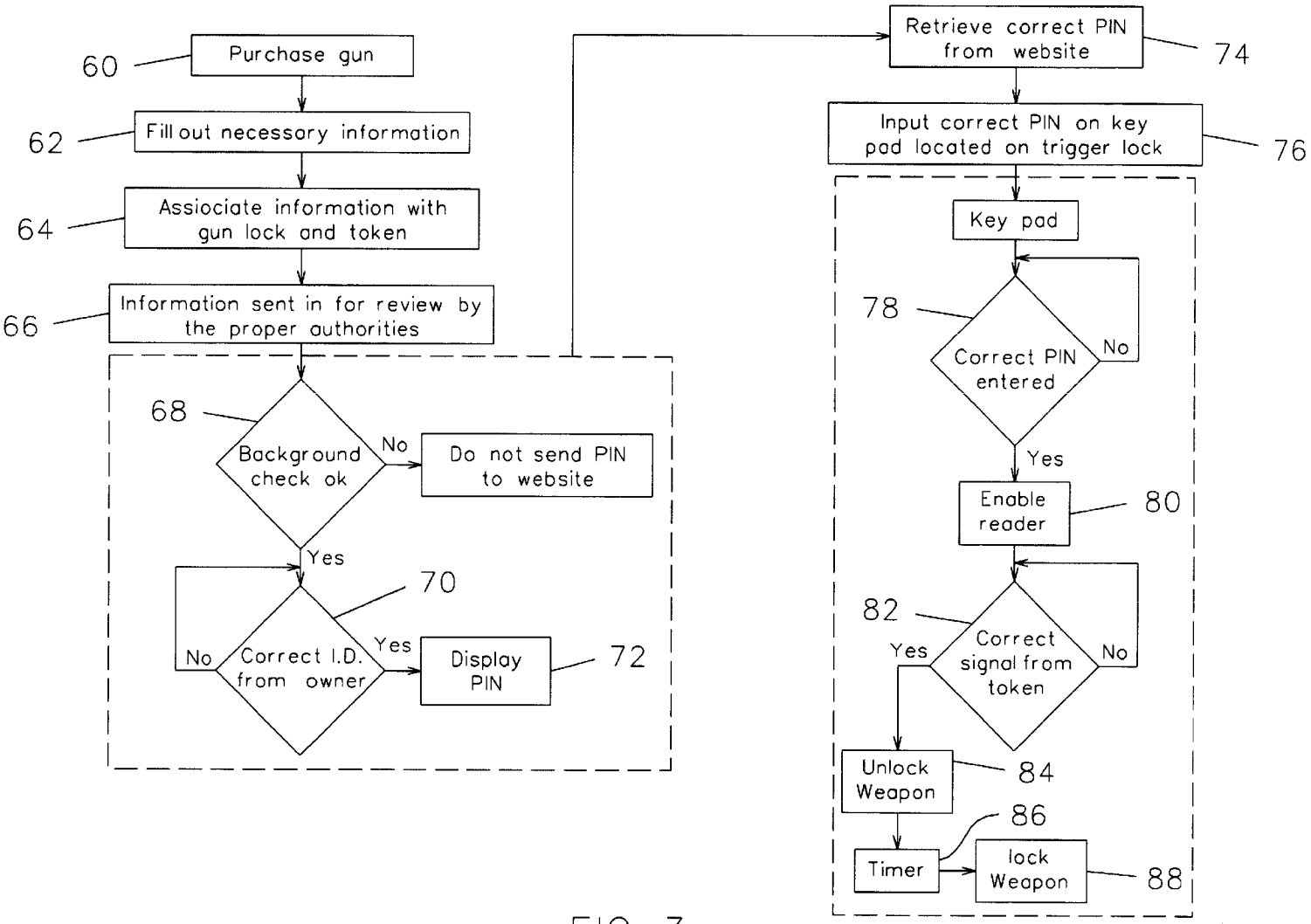
FIG. 3 is a flowchart illustrating the steps for using the present system with the logic of a central computer and trigger lock processor shown within dashed lines.
Figure 4:
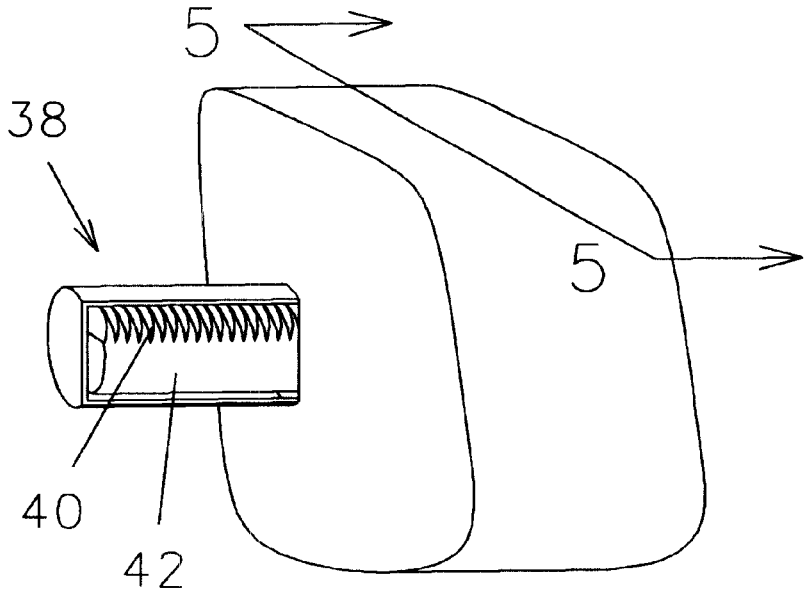
FIG. 4 is a another front perspective view taken from the side opposite that of FIG. 2.

Each trigger lock 20 includes a two-part housing having a first section 24 and a second section 26 with the second section 26 being releasably coupled to the first section 24. Each section presents a generally rectangular configuration and the sections are oriented in a back-to-back relationship for sandwiching a trigger guard 12 and trigger 14 of a firearm 10 therebetween. The first section 24 includes a front wall, a back wall, and a peripheral side wall connecting the front and back walls so as to define an interior space (FIG. 2). The first section 24 includes a numeric keypad 32 having keys extending from the front side thereof (FIGS. 1 and 2). Comparator circuitry 34 is positioned within the first section 24 (FIG. 5) and coupled to the keypad 32 for receiving a user input PIN therefrom. The comparator circuitry 34 and keypad 32 are electrically connected to a battery power source 36 in a conventional manner. The comparator circuitry 34 is able to compare the user input PIN with a predetermined code and, if they match, delivers a signal to enable operation of a read head, as to be further described below. The comparator circuitry is conventional. A locking bolt 38 extends from the back side of the first section and includes threaded and unthreaded portions. A locking bolt 38 is pivotally coupled to the back side of the first section 24 and is rotatable between locked and unlocked configurations. The locking bolt 38 includes threaded 40 and unthreaded 42 portions.

The second section 26 of the trigger lock housing also includes a front side, back side, and peripheral side wall. The back side of the second section 26 defines a cavity 28 which includes a threaded member 30 for engaging the threaded portion 40 of the locking bolt 38 in a locked configuration and lies adjacent the unthreaded portion 42 of the locking bolt 38 in the unlocked configuration. The locking bolt 38 is selectably rotated between locked and unlocked configurations by action of a spring-loaded solenoid 44, as to be further described below.

Each token 50 includes a generally oval-shaped token body 52 defining an aperture for receiving a key ring 16 therethrough and having at least one ferro-magnetic wire disposed within the token body 52. Ferro-magnetic wire is made from Vicalloy, cobalt, iron, and vanadium using a known process of twisting, untwisting, and age hardening such that the magnetic polarity of the wire is switched then reversed when an alternating magnetic field of sufficient strength is applied thereto. This switch reversal invokes electromagnetic impulses. The number and spacing of these wires is varied between different ones of the tokens 50 such that each token produces a unique, coded pulse train when exposed to a magnetic field that is suitable to cause the magnetic state of the wires to reverse.

Figure 5:
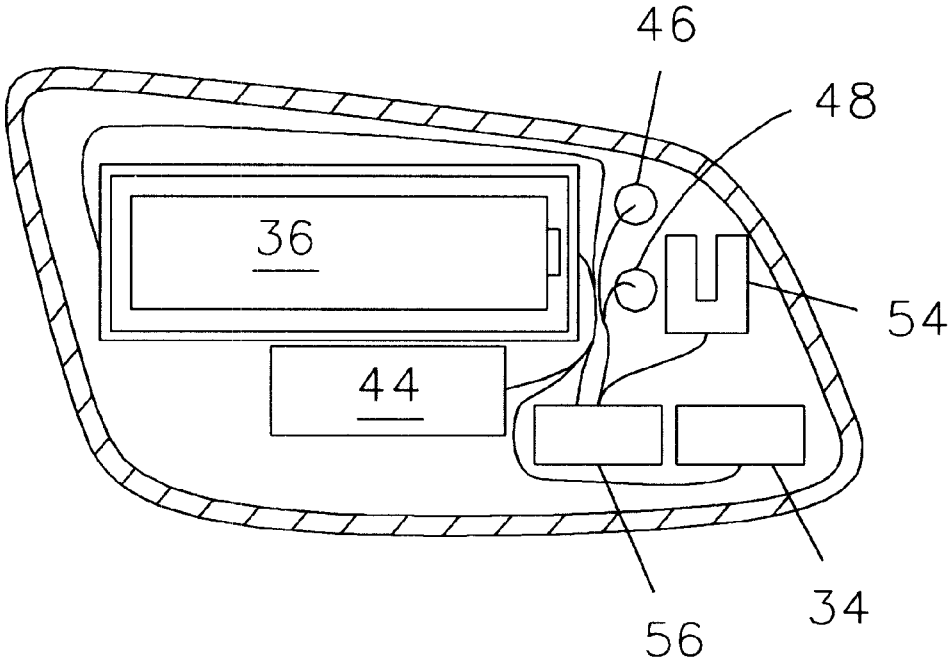
FIG. 5 is a sectional view of a first section of the trigger lock housing taken along line 5—5 of FIG. 2.

As shown in FIG. 5, a read head 54 is mounted within the first section 24 of each trigger lock housing. Preferably, each read head 54 comprises a pair of magnets arranged to produce an alternating magnetic field of sufficient strength to cause magnetic switching in wires of a token passed proximately thereby, such switching invoking electromagnetic voltage pulses across the read head 54. The read head 54 is coupled to a processor 56 mounted within the interior space of the first section 24 of the housing. The processor 56 is capable of counting the number of pulses of the read head 54 and ascertaining the time duration between the pulses. This analysis may be converted into a numerical value and compared with a predetermined value representing the expected pulse train of a token corresponding to the PIN and trigger lock. If the actual pulse train and expected pulse train match, then the processor 56 delivers a signal to the solenoid 44 to release the second section 26 from the first section 24.

The solenoid 44 is positioned within the first section 24 of the trigger lock housing and is springably coupled to the locking bolt 38 for imparting rotational force thereto upon receipt of a signal from the processor 56. In the locked position, the threaded portion 40 of the locking bolt 38 mates with the threaded member 30 so as to hold the housing sections together. In the unlocked position, however, the locking bolt 38 is rotated such that the unthreaded portion 42 of the bolt 38 lies adjacent to the threads of the threaded member 30 such that the second section may be separated from the first section 24. It should be appreciated that the processor 56 includes a timing function which delivers another actuation signal to the solenoid 44 upon expiration of a predetermined amount of time following the first actuation signal, as shown in blocks 86 and 88 of FIG. 3. In other words, if the housing sections are not separated within the predetermined time window, the locking bolt 38 will be rotated into the locked position.

A battery 36 is positioned within the first section 24 of the trigger lock housing and is electrically connected to the comparator circuitry and processor in a conventional manner. The battery 36 is accessible through a battery compartment door 37 coupled to the first section 24. A first light emitting diode (LED) 46 extends through the front side of the first housing section 24 and is coupled to the battery 36 for indicating low battery power. A second LED 48 of a color different than that of the first LED 46 extends through the front side adjacent the first LED 46. The second LED 48 is electrically connected to the processor 56 and is energized when the processor signals the solenoid 44 to unlock the trigger lock housing. The second LED 48 is deenergized upon expiration of the timer.

In use, a firearm purchaser fills out documents 62 at the time of a firearm purchase 60 which will be used by a state or federal agency to conduct a background check 66 (FIG. 5). This documentation is associated with the identification code 22 of a trigger lock 20 and token 50 pair sold with the firearm 10, as indicated at block 64. If the background check is approved 68, a central computer connected to a wide area network prompts a user for a trigger lock/token identification code 22 and, if correct 70, displays an associated PIN 72. It is understood that the central computer may deliver the associated PIN via e-mail. The firearm purchaser may then take the PIN from the web site 74 and input it into the keypad 32 on the trigger lock 20, as indicated at block 76. If the comparator circuitry 34 within the first section 24 of the trigger lock housing indicates that the user-input PIN matches a predetermined or expected PIN, then the read head 54 is enabled 80. More particularly, the processor 56 is energized to analyze a magnetic pulse train. The user then passes the token 50 in close proximity to the first section 24 of the trigger lock housing. This invokes a series of electromagnetic pulses across the read head 54 as described earlier. If the processor 56 determines that a value representing the actual pulse train matches a predetermined value 82, the processor 56 delivers a signal to the solenoid 44 to impart rotational force to the locking bolt 38 and, therefore, to unlock the trigger lock housing, as indicated at block 84. If, however, the housing sections are not physically separated from one another within a predetermined time 86, another signal from the processor 56 to the solenoid 44 results in the locking bolt 38 being again rotated to a locked configuration 88.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. An electronic trigger lock for preventing unauthorized access to a trigger of a firearm, comprising:

a housing having a first section and a second section, said first section defining an interior space;

means for releasably coupling said second section to said first section of said housing;

a token having a token body and at least one ferro-magnetic wire disposed in said token body;

a read head disposed in said interior space of said first section and adapted to generate a plurality of output pulses in response to a switch in magnetic state of said at least one ferro-magnetic wire of said token upon said token being proximately aligned with said read head;

a processor mounted in said interior space and coupled to said read head for receiving said plurality of output pulses, said processor adapted to calculate an actual value representing the number and duration of said plurality of output pulses and to compare said actual value with a predetermined value, said processor adapted to deliver a signal to said coupling means when said actual value matches said predetermined value so as to release said second section from said first section;

a numeric keypad disposed on said housing for receiving a manually input personal identification number from a user; and comparator circuitry disposed within said interior space of said first section and coupled to said keypad for comparing said personal identification number with a predetermined access number, said comparator circuitry adapted to energize said read head when said personal identification number matches said access number.

2. A trigger lock as in claim 1 wherein said coupling means comprises:

a locking bolt pivotally coupled to a back side of said second section and having threaded and unthreaded portions, said locking bolt rotatable between locked and unlocked configurations;

a back side of said first section defining a cavity for selectively receiving said locking bolt; and a threaded member disposed in said cavity for engaging said threaded portion of said locking bolt at said locked configuration.

3. A trigger lock as in claim 2 wherein said coupling means includes a solenoid coupled to said locking bolt and electrically connected to said processor when said locking bolt is received in said cavity, said solenoid adapted to impart rotary motion to said locking bolt upon receipt of said release signal from the processor so as to rotate said locking bolt from said locked configuration to said unlocked configuration.

4. A trigger lock as in claim 1 further comprising a battery power source mounted in said interior space of said first section of said housing and electrically connected to said comparator circuitry and said processor.

5. A trigger lock as in claim 4 further comprising:

a first light emitting diode mounted on a front side of said first section and electrically connected to said processor, said first light emitting diode being energized for a predetermined period of time by said processor upon a matching of said actual value of said output pulses and said predetermined value;

a second light emitting diode mounted on a front side of said first section and electrically connected to said battery for indicating low battery power, said second light emitting diode having a color different from a color of said first light emitting diode.

6. A trigger lock as in claim 5 wherein said processor is adapted to deliver a second signal to said solenoid after said predetermined time for rotating said locking bolt from said unlocked configuration to said locked configuration if said bolt has not been removed from said cavity.

7. A trigger lock as in claim 1 wherein said token defines an aperture for receiving a key ring therethrough.

8. An electronic trigger lock for preventing unauthorized access to a trigger of a firearm, comprising:

a housing having a first section and a second section;

means for releasably coupling said second section to said first section;

an access token having a token body and at least one ferro-magnetic wire disposed in said token body;

a read head adapted to generate a plurality of voltage pulses in response to a switch in magnetic state of said at least one ferro-magnetic wire of said token upon said token being aligned proximately with said read head;

a processor coupled to said read head for receiving said plurality of voltage pulses, said processor coupled to said read head for receiving said plurality of voltage pulses, said processor adapted to calculate an actual value indicative of the number and duration of said plurality of voltage pulses and adapted to compare said actual value with a predetermined value, said processor adapted to deliver a signal to said coupling means when said actual value matches said predetermined value so as to release said second section from said first section of said housing; and a battery power source coupled to said processor for applying electrical energy thereto for operation.

9. A trigger lock as in claim 8 wherein said coupling means comprises:

a locking bolt pivotally coupled to a back side of said second section and having threaded and unthreaded portions, said locking bolt rotatable between locked and unlocked configurations;

a back side of said first section defining a cavity for selectively receiving said locking bolt; and a threaded member disposed in said cavity for engaging said threaded portion of said locking bolt at said locked configuration; and a solenoid coupled to said locking bolt and electrically connected to said processor when said locking bolt is received in said cavity, said solenoid adapted to impart rotary motion to said locking bolt upon receipt of said release signal from said processor so as to rotate said locking bolt from said locked configuration to said unlocked configuration.

10. A trigger lock as in claim 9 wherein said processor is adapted to deliver a second signal to said coupling means upon expiration of a predetermined period of time following delivery of said release signal, whereby said solenoid is adapted to impart rotary motion to said locking bolt upon receipt of said second signal so as to rotate said locking bolt from said unlocked configuration to said locked configuration if said locking bolt was not removed from said cavity within said predetermined period of time.

* * * * *